United States Patent [19]

Schrader et al.

[11] Patent Number: 4,832,214

[45] Date of Patent: May 23, 1989

[54] GLOWING BABY BOTTLE NIPPLE COLLAR

[76] Inventors: Jerome W. Schrader, P.O. Box 233, Fair Oaks, Calif. 95628; Kyle R. Weatherby, 6137 Rushmore Dr., Sacramento, Calif. 95842

[21] Appl. No.: 170,328

[22] Filed: Mar. 18, 1988

[51] Int. Cl.[4] ..... A61J 9/00; A61J 11/04; B65D 41/08

[52] U.S. Cl. ..... 215/11.1; 215/230; 215/276

[58] Field of Search ..... 215/11.1–11.6, 215/295, 230, 276; 128/360; 250/462.1, 463.1, 464.1, 465.1, 466.1, 467.1; D24/46, 47; D9/436

[56] References Cited

U.S. PATENT DOCUMENTS

| | | | |
|---|---|---|---|
| D. 278,311 | 4/1985 | Brown et al. | D9/436 |
| D. 286,911 | 11/1986 | Campbell et al. | D24/47 |
| 1,032,610 | 7/1912 | Kern | 250/462.1 |
| 1,349,396 | 8/1920 | Van Clief | 250/462.1 X |
| 2,448,569 | 9/1948 | Allen | 215/11.1 |
| 2,577,030 | 12/1951 | Neumann | 215/100 R X |
| 2,644,890 | 7/1953 | Hollihan | 250/462.1 |
| 2,831,596 | 4/1958 | Eyles | 215/11.1 |
| 2,834,496 | 5/1958 | Boston et al. | 215/11.1 |
| 2,954,030 | 9/1960 | Jozwiak | 215/11.1 |
| 3,017,051 | 1/1962 | Rosenfeld | 215/100.5 |
| 3,022,915 | 2/1962 | Mullin | 215/11.1 |
| 3,411,003 | 11/1968 | Pearce | 250/462.1 |
| 3,650,270 | 3/1972 | Frazier | 215/11.1 X |
| 4,688,571 | 8/1987 | Tesler | 128/360 |
| 4,759,453 | 7/1988 | Paetzold | 215/11.6 X |

FOREIGN PATENT DOCUMENTS

| | | | |
|---|---|---|---|
| 568754 | 1/1959 | Canada | 128/360 |
| 2594328 | 8/1987 | France | 128/360 |
| 2169811 | 7/1986 | United Kingdom | 128/360 |

OTHER PUBLICATIONS

"Plastics That Glow In The Dark", Modern Plastics, pp. 88–91, vol. 26, Oct., 1948.

*Primary Examiner*—Sue A. Weaver

[57] ABSTRACT

A non-toxic luminescent nipple retaining collar is provided for baby bottles which enables those bottles to be seen and retrieved in the dark without the aid of light. The invention aids parents in locating the nursing bottle without turning on the light and completely awakening a child or others in the room. The child, if old enough, can retrieve the bottle himself and save the parents a trip. The retaining collar can absorb and store light from any natural or incandescent light source and emit that light for an extended period of time.

2 Claims, 2 Drawing Sheets

GLOWING BABY BOTTLE NIPPLE COLLAR

BACKGROUND OF THE INVENTION

1. Field of the Invention

This invention relates to infant feeding bottles and more precisely to nipple retaining collars manufactured with luminescent material which enables the bottle to be visible in the dark.

2. Description of the Prior Art

Past art patents were examined from a search conducted in the following classes and subclasses:

215/11R, 128/359, 360, 252, and 250/462.1.

The following patents were those produced by the search:

A patent issued to Kern on July 16, 1912, U.S. Pat. No. 1,032,610, shows a poison indicating bottle with a permanently disposed interior chamber housing a light emitting compound. This device would not be adaptable for use as a baby bottle nor especially as a collar thereof, due to the threadless neck of the bottle and the luminescent material being retained within a chamber in the bottle wall, posing a potential danger if the bottle was broken and the material ingested.

U.S. Pat. No. 1,349,396, issued to Van Clief, dated Aug. 10, 1920, shows luminous labels, particularly directed towards preventing administering harmful medications or compounds. This device would be unsuitable for use with baby bottles due to the fact the labels could be inadvertently removed by the child and ingested, and constant washing would deteriorate the label.

A patent issued to Hollihan, dated July 7, 1953, U.S. Pat. No. 2,644,890, teaches an assortment of luminescent amusement devices. None of the devices cited in the patent claim to be for use with beverage containers of any kind nor could they be substituted with our invention to accomplish the same directives.

Rosenfeld received U.S. Pat. No. 3,017,051, dated Jan. 16, 1962, which shows luminescent beverage coasters. It is obvious the only connection between this device and our invention is the light emitting properties possessed by both.

A patent issued to Skidmore on June 1, 1965, U.S. Pat. No. 3,186,411, illustrates a luminous pacifier for infants. This invention is not designed for use with baby bottles and could not be substituted for our device.

Pearce was issued U.S. Pat. No. 3,411,003, on Nov. 12, 1968, which shows an illuminated novelty bar display apparatus in which portions of beverage glasses or mugs are illuminated by a concealed apparatus located under a counter or bar. The devices outlined in this patent require an additional outside electrical apparatus to generate the luminescent effect, whereas our invention will function independently for an extended period of time.

Frazier was issued U.S. Pat. No. 3,650,270, dated Mar. 21, 1972, which teaches a non luminous nipple-retaining ring assembly for baby bottles. This device is not designed for, nor does it anticipate solving, the problem of locating a bottle in a darkened environment.

A patent issued to Tesler, U.S. Pat. No. 4,688,571, dated Aug. 25, 1987, shows a one-piece luminous pacifier. As with the previous pacifier, this device is not designed to retain a nipple to a bottle.

U.S. Pat. No. Des. 286,911, issued to Campbell on Nov. 28, 1986, shows a baby bottle having an aperture through the bottle portion of the unit. Being a design patent, this application makes no claim as to the function of the device, being issued on appearance only. Our device not only has structural differences but has an explicit function and purpose, having the ability to been seen in the dark.

A design patent issued to Brown et al, issued on Apr. 9, 1985, U.S. Pat. No. Des. 278,311, shows a combined hood and collar for a baby bottle. Being a design patent as was the previously mentioned device, the same argument applies; definite structural differences exist and no function is claimed as to the device being luminescent or visible in the dark.

To our knowledge, the foregoing patents represented devices most pertinent to our invention. Bottles for nursing infants have been in use for a considerable length of time and improvements made over the years have effectively increased nursing bottle efficiency. No viable improvement, however, has been accomplished towards solving the problem of locating a misplaced bottle in the dark. On many occasions where a parent wishes to quiet a child or put a child to bed without turning the light on and risking an awakening the bottle cannot be found in the dark. Even if the child is crying, and especially if there are others in the room, the risk of completely awakening him or her is greater if a light is turned on. There are other times when a light is not readily available, such as when camping or traveling at night, and the bottle must be located by touch. Also if a child is older, he or she can easily reclaim a bottle that can be seen and save the parents a trip. Therefore, a bottle which can be located at night or in dark environments without the aid of a light has obvious benefits. None of the previous patents were structured for the purpose of illuminating a baby bottle for the intention of making location of the device easier at night. We therefore. feel our device has new and useful features not found in the past art devices.

SUMMARY OF THE INVENTION

In practicing our invention, we have developed an eight sided plastic illuminated nipple collar, with an accessary protective cap, for retaining a nipple on a conventional baby bottle.

Therefore, it is a primary object of our invention to provide a plastic non-toxic luminescent nipple collar for baby bottles which allows the collar to glow in the dark, making the assembled bottle visible and therefore easy to locate at night.

Another object of our invention is to provide a light emitting nipple collar adapted to be utilized with all conventional baby bottles.

A further object of our invention is to provide a nipple collar manufactured of a luminescent material capable of absorbing light from artificial or natural sources, such as light bulbs and the sun, and then retaining and emitting that light for an extended period of time.

A still further object of our invention is to provide an illuminated, octagonal nipple collar having vertical striations on the eight sides for better gripping traction, useful when applying the cap to the bottle.

An even further object of our invention is to provide an illuminated nipple collar manufactured of a non-toxic commercially available luminescent material, provided in pigments, vinyl films and paint, which is heat resistant, dishwasher and microwave safe, and available in a variety of colors.

Other objects and advantages of our invention will become apparent from a study of the following specification and accompanying drawings, which are in themselves merely illustrative of the structure of the device.

DRAWING REFERENCE NUMBERS

Figure 1:
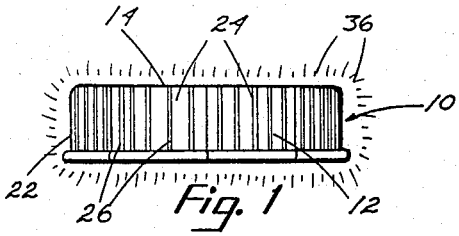
FIG. 1 is a side view of the preferred embodiment.
Figure 2:
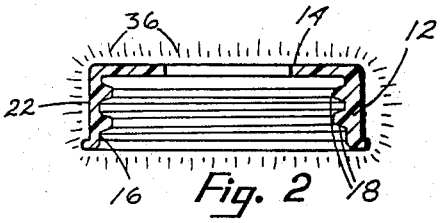
FIG. 2 is a cross sectioned side view showing internal threads.
Figure 3:
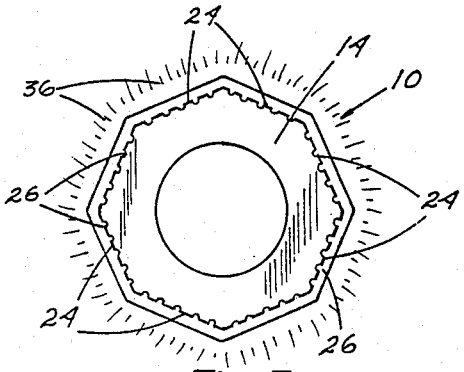
FIG. 3 is a top view.
Figure 4:
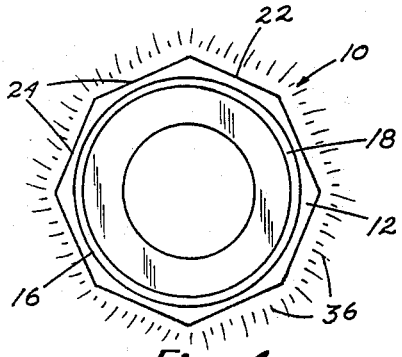
FIG. 4 is a bottom view.
Figure 5:
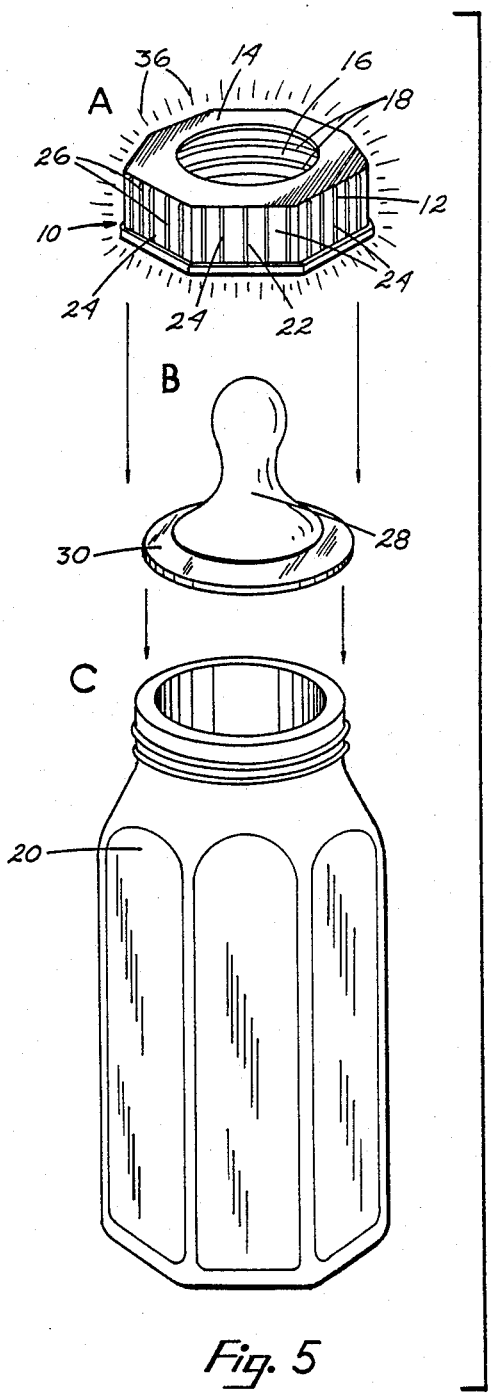
FIG. 5 A is a perspective view of the collar positioned over B, a nipple, which in turn is positioned over C, a bottle.
Figure 6:
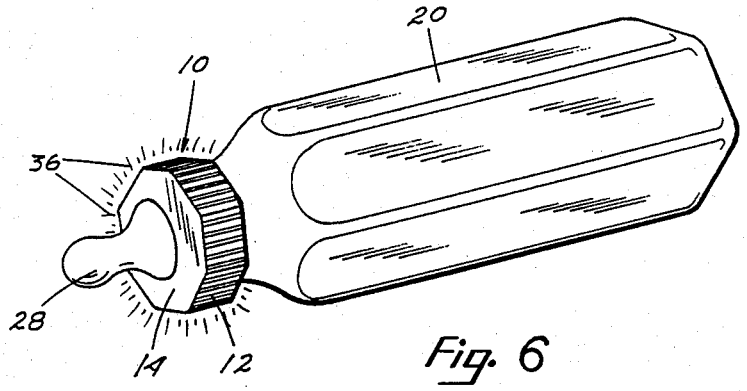
FIG. 6 is a perspective view of the preferred embodiment assembled onto a bottle with attached nipple.
Figure 7:
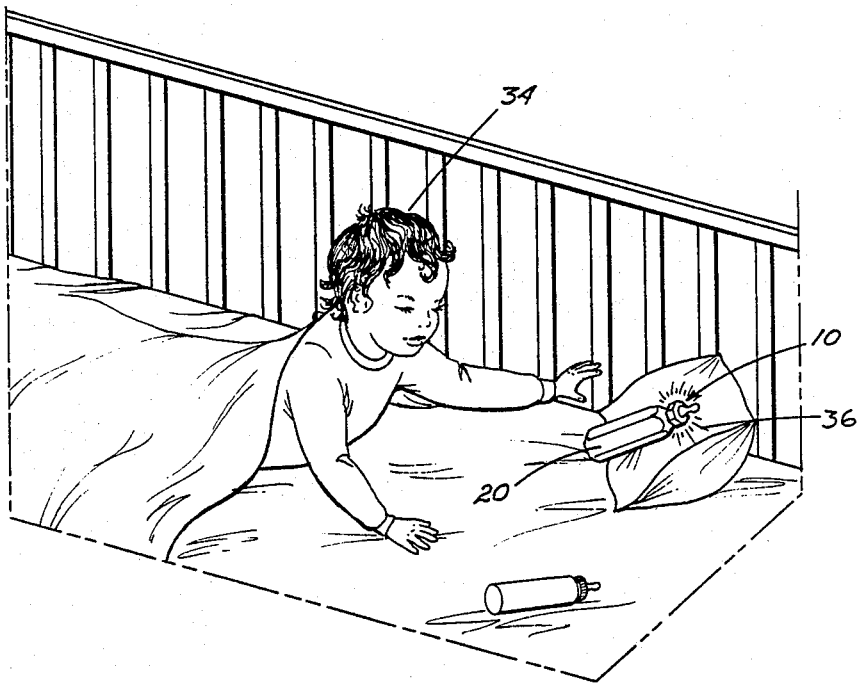
FIG. 7 illustrates the illumination of the preferred embodiment permitting the device to be visible over a conventional bottle.

10 retaining collar
12 tubular ring wall
14 apertured surface
16 interior wall surface
18 interior threads
20 bottle
22 exterior wall surface
24 panels
26 striations
28 nipple
30 nipple flange
34 baby
36 luminescence

DESCRIPTION OF THE PREFERRED EMBODIMENT

Referring now to the drawings at FIG. 1 where the preferred embodiment of our invention is illustrated in a side view. Retaining collar 10 can be manufactured of a variety of thermoplastics which are readily available on the open market. One suggested material used for the glow-in-the-dark effect is non-toxic SPOT-LITE GLO SERIES 1000 and 5100 manufactured by Hanovia, a division of Canrad Inc., 100 Chestnut St., Newark, NJ 07105. SPOT-LITE GLOW in-the-dark material can be added to the base thermoplastic material in the form of pigments or dies, and is then molded as an intrinsic part of the device. SPOT-LITE SERIES 5100 Paints can also be applied after the device has been molded.

Retaining collar 10 is comprised of short tubular ring wall 12 having an opened bottom section and a top section constituting apertured surface 14. Interior wall surface 16 of tubular ring wall 12 contains a series of interior threads 18 which serve as the means of attachment for retaining collar 10 to bottle 20. Exterior wall surface 22 is formed into an octagon with eight vertical panels 24. Exterior wall surface 22 also has a multiple of vertical striations 26 which form a gripping surface.

During assembly, retaining collar 10 is inserted over nipple 28, through apertured surface 14, with nipple flange 30 in horizontal contact with the inside surface of apertured surface 14. Retaining collar 10, with inserted nipple 28, is then attached to the threaded neck of bottle 20 by interior threads 18. When assembled onto bottle 20, retaining ring 10 can be easily seen in the dark by baby 34 due to luminescence 36, produced by retaining collar 10.

Retaining collar 10 can be "recharged" from any light source, even household lamps, and will retain and slowly emit that light over an extended time. When the luminescence becomes too dim, retaining collar 10 can be placed in a window sill or under a lamp for as little as 30 minutes and retain luminescence for up to eight hours, varying slightly depending upon the intensity of light absorbtion.

We claim:

1. A luminescent glow-in-the-dark collar for retaining a nipple on a baby bottle, comprising;

a. a tubular ring wall sized to encompass an open neck of said baby bottle, said ring wall having a substantially flat apertured top surface and an oppositely disposed opened bottom end;

b. threads on an interior surface of said ring wall sized for attachment of said opened bottom end to threads on said neck of said baby bottle;

c. means for retaining said nipple with said means being said aperture of said flat apertured surface sized to receive said nipple with a flange of said nipple being retained between an inside surface of said flat apertured surface and a top edge of said baby bottle neck;

d. structure forming a gripping means on an outside surface of said ring wall for rotating said collar on said baby bottle neck;

e. said collar manufactured of a non-toxic phosphorescent pigmented thermoplastic compound.

2. The device of claim 1 with said structuring forming a gripping means is a plurality of striations.

* * * * *